US005518056A

United States Patent [19]

Voss

[11] Patent Number: 5,518,056

[45] Date of Patent: May 21, 1996

[54] SAFETY TASSEL FOR PULL CORDS OF WINDOW COVERINGS

[75] Inventor: Robert J. Voss, Fountain Valley, Calif.

[73] Assignee: Newell Operating Company, Freeport, Ill.

[21] Appl. No.: 287,238

[22] Filed: Aug. 8, 1994

[51] Int. Cl.[6] ..... E06B 9/38

[52] U.S. Cl. ..... 160/178.1; 24/115 F

[58] Field of Search ..... 160/178.1 R, 178.1 V, 160/173 R, 173 V, 178.2 R, 168.1 R, 168.1 V, 320; 24/115 F, 115 H, 115 G; 16/114 B, 122, 217, 218, DIG. 12; 428/28

[56] References Cited

U.S. PATENT DOCUMENTS

| | | | |
|---|---|---|---|
| 80,545 | 8/1868 | Hill | 16/122 |
| 477,154 | 6/1892 | Quein . | |
| 602,569 | 4/1898 | Turner . | |
| 704,265 | 7/1902 | McMaster . | |
| 1,344,818 | 6/1920 | Pogue . | |
| 2,036,953 | 4/1936 | Morris . | |
| 2,247,322 | 6/1941 | Stuber . | |
| 2,398,436 | 4/1946 | Mason | 16/114 |
| 2,452,796 | 11/1948 | Skibsted . | |
| 2,478,124 | 8/1949 | Mussman . | |
| 2,624,086 | 1/1953 | Schaefer . | |
| 2,637,887 | 5/1953 | Goodman et al. . | |
| 2,907,134 | 10/1959 | Trautvetter . | |
| 3,050,803 | 8/1962 | Hulterstrum . | |
| 3,108,346 | 10/1963 | Bey . | |
| 3,263,444 | 8/1966 | Di Croce . | |
| 3,485,285 | 12/1969 | Anderle . | |
| 3,589,341 | 6/1971 | Krebs . | |
| 3,727,665 | 4/1973 | Debs . | |
| 4,044,725 | 8/1977 | Miller . | |
| 4,186,690 | 2/1980 | Seiler . | |
| 4,233,923 | 11/1980 | Casad et al. . | |
| 4,366,852 | 1/1983 | Holzer . | |
| 4,370,783 | 2/1983 | Fretwell, Jr. . | |
| 4,445,253 | 5/1984 | Howey . | |
| 4,477,947 | 10/1984 | Lyons . | |
| 4,635,698 | 1/1987 | Anderson . | |
| 4,909,298 | 3/1990 | Langhart et al. . | |

*Primary Examiner*—David M. Purol
*Attorney, Agent, or Firm*—Foley & Lardner

[57] ABSTRACT

A safety tassel (10) for use with at least two vertically projecting pull cords (20,22) for a window covering is disclosed. The tassel (10) has at least two elements (12,14), each receiving and retaining a pull cord (20,22) and having an outwardly projecting gripping finger (30,36) for releasably interconnecting the other element (14,12) such that the elements (12,14) are detached from each other when outward forces transverse to the pull cords (20,22) are applied by the pull cords (20,22) to the elements (12,14).

10 Claims, 1 Drawing Sheet

SAFETY TASSEL FOR PULL CORDS OF WINDOW COVERINGS

DESCRIPTION

1. Technical Field

The present invention relates generally to pull cord tassels for window coverings that are releasably interconnected, and more particularly, to a safety tassel to prevent children from accidently injuring themselves when they contact such cords.

2. Background of the Invention

Most window coverings, such as horizontal blinds, have pull cords to adjust the height of the window covering. The blind comprises a plurality of equally spaced, parallel, horizontal slats or louvers. The pull cords generally extend downwardly from a headrail assembly positioned within or behind a valance assembly adjacent the top of the window being covered. In traditional configurations, the cord assembly which raises and lowers the bottommost slat or sill rail of the window covering is a closed-loop. The closed-loop has two cords extending downwardly from the headrail which meet to form a U-shape or loop. One of the downwardly extending cords adjusts the horizontal positioning of the bottommost slat or sill rail of the window covering while, the other cord adjusts the other end of the same slat or sill rail. To maintain the window covering in a horizontal position, or level, while at the same time adjusting the height of the bottommost slat or sill rail, both cords must be pulled simulataneously with equal force.

Unfortunately, pull cords present dangers for small children. Small children have been known to play with the pull cords by pulling on the cords or putting the cords in their mouths. Very small children often play with the pull cords because their cribs may be placed next to a window covering with such cords. When children play with the pull cords, their heads may become entangled in the cords or they playfully place their heads through the pull cords. As a result, children have been injured by the pull cords; they have fallen out of their cribs while being held above the floor by the closed-loop pull cords.

One way to prevent the danger is to eliminate the closed-loop pull cord. However, closed-loop pull cords are desirable as they easily adjust the height of the window covering while maintaining the window covering in a horizontal position. To solve this problem, releasably interconnected fasteners, or safety tassels, have been developed. The fasteners attach to the end of each pull cord and establish a closed-loop between the pull cords, allowing the cords to separate if a sufficient force, such as the weight of a child, is applied to the fastener.

SUMMARY OF THE INVENTION

The present invention relates to a safety tassel. According to a first aspect of the invention, the safety tassel is used with at least two vertically projecting pull cords for window coverings and the like. The safety tassel generally comprises a first element and a second element and at least one gripping finger. Specifically, the first and second elements each have an outer, or exterior surface, and an internal passageway for receiving the pull cords. The internal passageway of each element also has an internally projecting flange therein for cooperating with a stop formed in or attached to the pull cords for retaining the pull cords within the elements.

As to the gripping finger, it projects outwardly from the outer surface of the one element and has a socket at the distal end with an internal socket surface. The internal socket surface is configured substantially similar to the outer surface of the other element for gripping the other element establishing a tension resisting releasable connection between the elements. The elements are detached from each other, however, when horizontal component forces, which are transverse to the pull cords, are applied by the pull cords to the elements.

According to another aspect of the present invention, the outer surface of each of the elements is cylindrical and the socket of each gripping finger is cylindrical. In addition, each of the elements has two ends, the gripping finger being positioned adjacent one end and an annular channel portion being formed adjacent the other end. The gripping finger of each element cooperates with the channel portion of the other element establishing a detachable connection between the elements.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE PREFERRED EMBODIMENT

Figure 1:
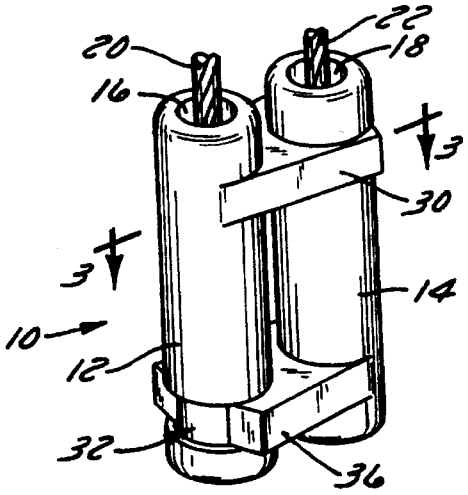
FIG. 1 is a perspective view of the safety tassel made in accordance with the teaching of the present invention in which the first and second elements are interconnected and portions of two pull cords are shown extending into the passageways of the first and second elements.

While this invention is susceptible of embodiment in many different forms, there is shown in the drawings and will herein be described in detail, some preferred embodiments of the invention with the understanding that the present disclosure is to be considered as an exemplification of the principles of the invention and is not intended to limit the broad aspect of the invention to the embodiments illustrated.

Figure 2:
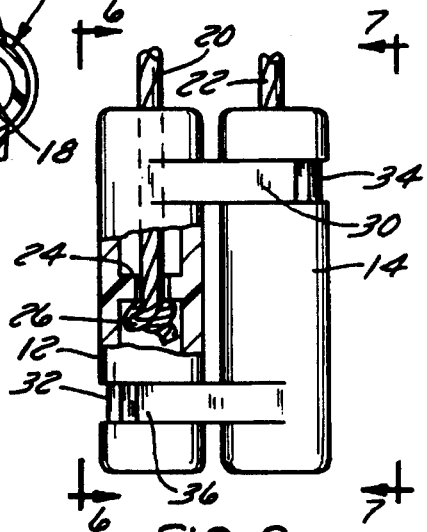
FIG. 2 is a front elevation view of the safety tassel with a partial sectional view through the first element showing an internal flange which retains the pull cord within the element.

Referring to the drawings, FIG. 1 shows the safety tassel of the present invention, generally designated by the reference number 10. The safety tassel 10 is used with at least two vertically projecting pull cords 20,22 that are generally used with window coverings (not shown) and the like. The safety tassel 10 generally comprises a first element 12 and a second element 14. Each element 12,14 has a cylindrical outer surface and also has means for receiving and retaining at least one of the pull cords 20,22. The receiving and retaining means of each element 12,14 includes an internal passageway 16,18 and an internally projecting flange therein as shown in the partial cross-section in FIG. 2. For example, the pull cord 20 is received by the internal passageway 16 of the first element 12 and is retained within the passageway 16 by the internal flange 24, having a concentric hole or channel therein cooperating with a stop 26 formed in or attached to the pull cord 20. The stop can be in the form of a knot tied in the pull cord 20. Although not shown in FIG. 2, it is understood that the second element 14 has an identical flange 25 within its passageway 18 for cooperating with the stop 27, or knot in the pull cord 22.

The safety tassel 10 also has gripping means on each element 12,14 for releasably interconnecting the elements 12,14 together. The elements 12,14 are detached from each other when outward forces transverse to the pull cords 20,22 are applied by the pull cords 20,22 to the elements 12,14.

Figure 8:
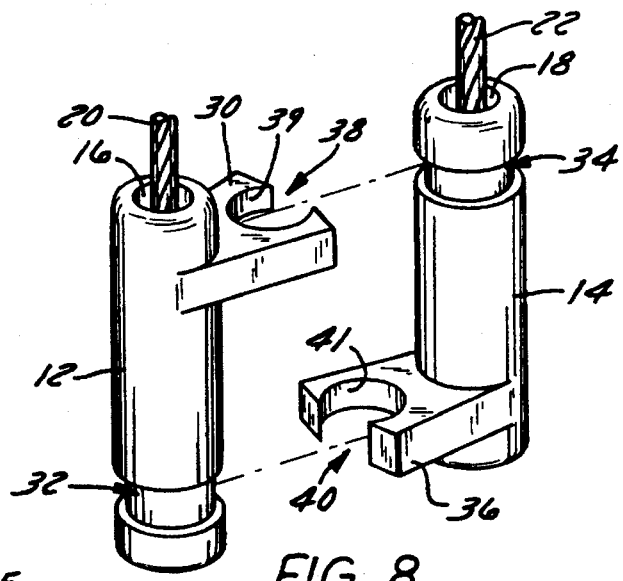

Specifically, as best seen in FIG. 8 where the first and second elements 12,14 are detached, the gripping means on each element is an outwardly projecting gripping finger 30,36. Each gripping finger 30,36 has a socket 38,40 formed at the distal end of the gripping finger 30,36 for gripping the outer surface of the other element therein. The socket 38,40 of each gripping finger is cylindrical and defines an internal socket surface 39,41. This surface is configured substantially similar to the outer surface of the other element for gripping the other element.

Each of the elements 12,14 also has two opposed ends. The gripping finger 30 of the first element 12 is positioned adjacent one end and an annular channel portion 32 is formed adjacent the other, opposed end. Conversely, the second element 14 has an annular channel portion 34 positioned at one end, and the gripping finger 36 positioned at the other end. The two elements are positioned in reverse relationship to one another when in cooperation with one another. For example, the end closest to the entry of the pull cord of one element is the end furthest from the entry of the pull cord of the cooperating element. In this manner, the gripping finger of one element is aligned with the annular channel of the other element. In addition, in manufacturing, only one element needs to be produced to make the tassel. One element is oriented with one end up and the other element, having the exact same construction, has the other end up. Consequently, if the tassel is made of a rigid plastic, only one mold needs to be made for the elements.

As to the dynamics on the cooperation between the elements, FIG. 1 shows the gripping finger 30,36 of each element 12,14 cooperating with the annular channel portion 32,34 of the other element. The gripping finger 30 of the first element 12 receives the annular channel portion 34 of the second element 14. At the same time, the gripping finger 36 of the second element 14 receives the annular channel portion 32 of the first element 12. In a preferred form of the invention, these connections are in snap-fit relation, although it is understood by those skilled in the art that other types of connections are possible. This connection between the first and second elements 12,14 is a tension resisting releasable connection. The gripping fingers 30,36 grip the other element such that the elements 12,14 are detached from each other when the horizontal forces H (FIG. 5) transverse to the pull cords 20,22 are applied by the pull cords 20,22 to the elements 12,14 in a direction away from the center of the assembly. A horizontal component H will be present in any force F that is not a purely vertical force V (FIG. 5).

Figure 3:
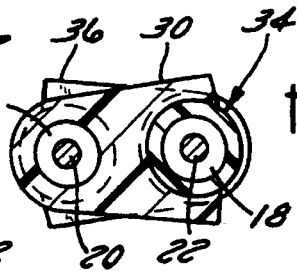
FIG. 3 is a top sectional view of the safety tassel taken along line 3—3 in FIG. 1 showing the gripping finger of the first element in cooperation with the annular channel portion of the second element.

As noted in the prior section regarding the figures, FIGS. 3–7 show different views of the safety tassel 10. FIG. 3 shows the gripping finger of each element cooperating with the annular channel portion of the other element 14. The gripping finger wraps around the annular channel portion in snap-fit relation. Although not shown through a sectional view, FIG. 4 discloses the gripping finger 36 of the second element 14 receiving the annular channel portion 32 of the first element 12 in the same manner as disclosed in FIG. 3.

Figure 4:
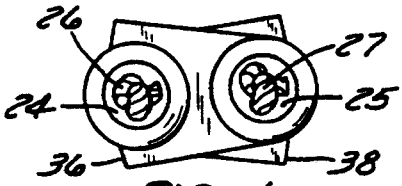
FIG. 4 is a bottom view of the safety tassel showing stops, or knotted portions, formed in the pull cords to retain the pull cords in the passageways of the elements.

FIG. 4 also shows the knot 26 forming a stop in the cord 20 as well as a knot 27 forming a stop in the cord 22. These knots 26,27 are retained by the internal flanges 24,25 located within the elements 12,14.

Figure 5:
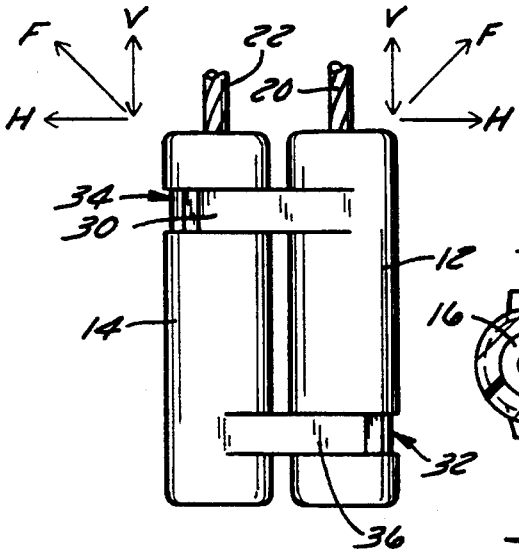
FIG. 5 is a rear elevation view of the safety tassel.
Figure 6:
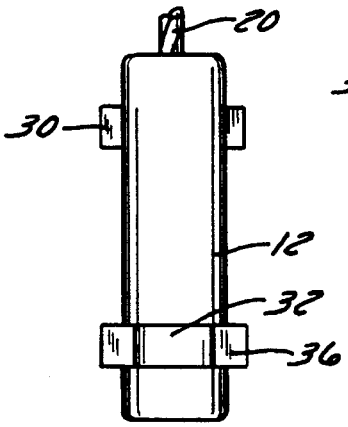
FIG. 6 is a side elevation view of the safety tassel taken from line 6—6 in FIG. 2.
Figure 7:
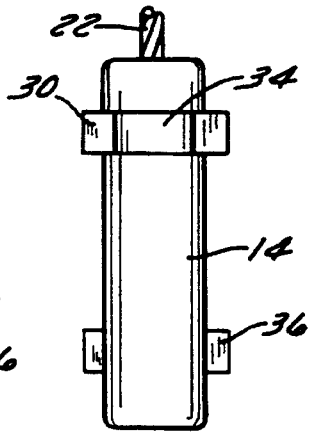
FIG. 7 is a side elevation view of the safety tassel taken from line 7—7 in FIG. 2; and, FIG. 8 is a perspective view of the safety tassel showing the first and second elements detached.

FIG. 5 is rear elevation view showing the first and second elements 12,14 releasably connected. FIGS. 6 and 7 are side views showing the gripping fingers 30,36 cooperating with the annular channel portions 32,34 in snap-fit relation.

When used with a window covering, the pull cords 20,22 of the window covering are retained in the respective elements 12,14 of the safety tassel 10. The elements 12,14 are then interconnected as previously described wherein the pull cords 20,22 and safety tassel 10 form a closed-loop configuration. Exerting a pure downward force V, or a downward force without any outward, horizontal components thereto, on the safety tassel 10, such as when adjusting the vertical position of the bottommost slat or sill rail of the window covering, will not separate the first and second elements 12,14. However, if sufficient outward forces, transverse to the pull cords 20,22, are applied to the first and second elements 12,14, the elements 12,14 will detach breaking the closed-loop. Such a result occurs for example, if a child plays with the pull cords 20,22 of the window covering while standing in a crib. If a child becomes entangled in the pull cords 20,22, its weight alone on the pull cords and tassel will cause a separation of the elements preventing the child from injury. Once separated, the elements may be easily reconnected as described above.

Finally, while two elements are shown, the present invention may be constructed with three or more elements. With some window coverings, more than two pull cords are employed. In such instances, the tassel would then be formed of a cluster of elements, with each element holding a cord and cooperating in the manner just described with one or more of the other elements within the cluster.

While the invention has been described with reference to some preferred embodiments of the invention, it will be understood by those skilled in the art that various modifications may be made and equivalents may be substituted for elements thereof without departing from the broader aspects of the invention. The present examples and embodiments, therefore, are illustrative and should not be limited to such details.

I claim:

1. A safety tassel for use with at least two vertically projecting pull cords for window coverings and the like comprising:

a first element with means for receiving and retaining at least one of the pull cords;

a second element with means for receiving and retaining at least one of the pull cords;

gripping means on each element for releasably interconnecting the other element such that the elements are detached form each other when outward forces transverse to the pull cords are applied by the pull cords to the elements; and, wherein the gripping means on each element is a projecting gripping finger, each element has an outer surface and each gripping finger cooperates with the outer surface of the other element, and the gripping finger has a socket formed at the distal end of the gripping finger for gripping the outer surface of the other element therein.

2. The tassel as defined in claim 1 wherein the outer surface of each of the elements is cylindrical and the socket of each gripping finger is cylindrical.

3. The tassel as defined in claim 2 wherein each of the elements has two ends, the gripping finger being positioned adjacent one end and an annular channel portion being formed adjacent the other end, each gripping finger of each element cooperating with the channel portion of the other element.

4. The tassel as defined in claim 3 wherein the means for receiving and retaining at least one of the pull cords in each of the elements is an internal passageway and an internally projecting flange therein for cooperating with a stop formed in or attached to the pull cord.

5. The device of claim 4 wherein the gripping finger of each element receives the annular channel portion of the other element in snap-fit relation.

6. A safety tassel for use with at least two vertically projecting pull cords for window coverings and the like comprising:

a first element having an internal passageway and an internally projecting flange therein for receiving and retaining at least one of the pull cords;

a second element having an internal passageway therein and an internally projecting flange therein for receiving and retaining at least one of the pull cords;

gripping means on each element for releasably interconnecting the other element such that the elements are detached from each other when outward forces transverse to the pull cords are applied by the pull cords to the elements; and, wherein each element has a cylindrical outer surface and a gripping means for each element is a gripping finger with a socket formed at the distal end thereof for engaging the outer surface of the other element therein.

7. The tassel as defined in claim 6 wherein each of the elements has two ends, the gripping finger being positioned adjacent one end and an annular channel portion being formed adjacent the other end, each gripping finger of each element cooperating with the channel portion of the other element.

8. A safety tassel for use with at least two vertically projecting pull cords for window coverings and the like comprising:

a first element having an exterior surface and means for receiving and retaining at least one of the pull cords;

a second element having an exterior surface and means for receiving and retaining at least one of the pull cords, at least one of the elements having a gripping finger projecting outwardly from the outer surface of the one element and having a socket at the distal end with an internal socket surface configured substantially similar to the exterior surface of the other element for gripping the other element such that the elements are detached from each other when horizontal component forces that are transverse to the pull cords are applied by the pull cords to the elements; and, wherein the exterior surface of each of the elements is cylindrical and the socket of each gripping finger is cylindrical.

9. The tassel as defined in claim 8 wherein each of the elements has two ends, the gripping finger being positioned adjacent one end and an annular channel portion being formed adjacent the other end, each gripping finger of each element cooperating with the channel portion of the other element.

10. The tassel as defined in claim 9 wherein the means for receiving and retaining at least one of the pull cords in each of the elements is an internal passageway and an internally projecting flange therein for cooperating with a stop formed in or attached to the pull cord.

* * * * *